US006192729B1

(12) United States Patent
Offoiach

(10) Patent No.: US 6,192,729 B1
(45) Date of Patent: Feb. 27, 2001

(54) METHOD AND APPARATUS FOR RECEIVING AND DISCHARGING BARS

(75) Inventor: Renzo Offoiach, Tarcento (IT)

(73) Assignee: S.I.M.A.C. S.p.A., Tarcento (IT)

( * ) Notice: Subject to any disclaimer, the term of this patent is extended or adjusted under 35 U.S.C. 154(b) by 0 days.

(21) Appl. No.: 09/358,118

(22) Filed: Jul. 21, 1999

Related U.S. Application Data

(63) Continuation of application No. PCT/IT98/00005, filed on Jan. 16, 1998.

(51) Int. Cl.[7] ..... B21B 39/20
(52) U.S. Cl. ..... 72/250
(58) Field of Search ..... 72/250, 251; 198/450, 198/614

(56) References Cited

U.S. PATENT DOCUMENTS 3,610,437 * 10/1971 Barakov ..... 198/450
4,054,047 * 10/1977 Sclippa ..... 72/201

FOREIGN PATENT DOCUMENTS 1 127 813 5/1986 (IT) .
1 225 986 12/1990 (IT) .

* cited by examiner

*Primary Examiner*—Rodney A. Butler
(74) *Attorney, Agent, or Firm*—Wenderoth, Lind & Ponack, L.L.P.

(57) ABSTRACT

Disclosed is a method for receiving and discharging bars. Adjacent parallel rotating drums receive bars in longitudinal advancement and discharge them by dropping them onto an underlying cooling bed in a rolling mill plant. Each drum is provided with four opposite channels rotating in unison. At first two bars are fed in logic succession into two adjacent channels of a drum and, then at least two bars are fed in logic succession into at least two adjacent channels of the adjacent drum, and while a drum receives its two bars, the other one rotates for discharging its received bars. The discharging occurs in two progressive steps. First, rotation of the drum through a certain angle for allowing the discharge of a first bar and then, further rotation of the drum to allow the discharge of the second bar.

16 Claims, 2 Drawing Sheets

METHOD AND APPARATUS FOR RECEIVING AND DISCHARGING BARS

This application is a continuation of copending PCT application serial number PCT/IT98/00005, filed Jan. 16, 1998 which claims priority of Italian Patent Application No. UD97A000007, filed Jan. 21, 1997.

FIELD OF THE INVENTION

The invention has for an object a method and device for receiving and discharging bars. The device includes a couple of adjacent parallel rotating drums for receiving bars in longitudinal advancement and discharging them by dropping them onto an underlying cooling bed in a rolling mill plant.

BACKGROUND OF THE INVENTION

The production speed presently available in steel bars hot-rolling plants is about 35 m/sec. Such speed is difficult to increase. The main cause of this is the stand-off forced by the receiving of the rolling bars downstream of a well known "flying shear machine". A bar is sent on one side of the shear machine, and another bar on the other side into a known receiving and discharging device comprising channelled rotating drums having four externally open channels on each drum. After receiving a bar in a channel of each respective drum, the drums alternately discharge the bars downward, via rotation, onto an underlying cooling bed.

Increasing the speed of this receiving and discharging device which works very well and is reliable, was up to now practically impossible because of the time associated with rotating the drums to move the respective receiving channel from a receiving position to a discharge position at which the bar is discharged, and then using the same channel for receiving the following bar after rotation of the drums. Attempts to increase the speed were made, but produced only a solution for forwarding and discharging two bars together (SPLIT art).

This art is well described in the Italian patent in the name of the same applicant IT-83489A/88. This solution however requires discharging two bars at a time onto the underlying cooling bed with risk of tangling. Additionally, this method is complex, requiring the crossing of the channels of the two drums.

SUMMARY OF THE INVENTION

The purpose of the present invention is that of increasing the speed of the receiving and discharging device without substantially changing its structure.

The problem is solved by providing a method for operating the device for receiving and discharging bars. The device includes a couple of adjacent parallel rotating drums for receiving bars in longitudinal advancement of the bars, and then discharging the bars by dropping them onto an underlying cooling bed in a rolling mill plant. Each drum is provided with four opposite channels rotating in unison, characterized in that the method is capable of first sending two bars in logical succession into two adjacent channels of a drum and, then sending another two bars in logical succession into two adjacent channels of the adjacent drum, and while a drum receives its two bars, the other rotates and discharges its two received bars. Advantageously the discharging occurs in two progressive steps. First, a drum is rotated for a certain angle for allowing the discharge of a first bar and then, the drum is further rotated to allow the discharging of the second bar.

Thus it is possible by using each drum, to discharge one bar at a time onto the respective cooling bed underlying the drums, which cooling bed will transversely shift the different bars. Thus tangling risks can be avoided and the speed at which the bars are received and discharged can be considerably increased. The advantages are immediate, considering that by this solution it is possible to increase the production speed of the whole rolling mill plant from 35 m/sec. to 50 or 60 m/sec., while reducing the accelerations and decelerations inertia times and dead times. This is accomplished by discharging two bars from one drum and then two bars from the other drum, as opposed to a single bar from each drum.

BRIEF DESCRIPTION OF THE DRAWINGS

These and other advantages will become apparent from the following description of a preferred solution, with the aid of the included drawings, whose details are not to be considered as limiting but only as exemplifying.

DESCRIPTION OF THE PREFERRED EMBODIMENT

According to the figures, 5 indicates the receiving and discharging device comprising two drums according to the present invention, and 6 indicates the underlying cooling bed that horizontally and transversally translates the bars after they have been stopped in their longitudinal advancement within the respective channels (520) of each drum (52).

Each drum, as in the prior art, is mounted on a rotating axis (51). A head motor (not shown) is used for rotating each drum (52) through an angle.

Each drum (52) is covered by a crankcase (53) that prevents the bars in the channels from coming out of their respective channels (520) until suitable drum rotation has occurred.

According to the invention the bars are sent in succession into the channels as depicted by 1, 2, 3 and 4. This means that two subsequent bars for each drum are sent into their respective channels, instead of one bar for each drum as is done in the prior art. This allows the bars to be discharged at about twice the rate of the prior art. This also enables the respective drum to rotate through 180° instead of 90° as in the prior art, before the other drum is rotated whereby the crossing of the channels during discharging of four bars is eliminated.

Figure 1:
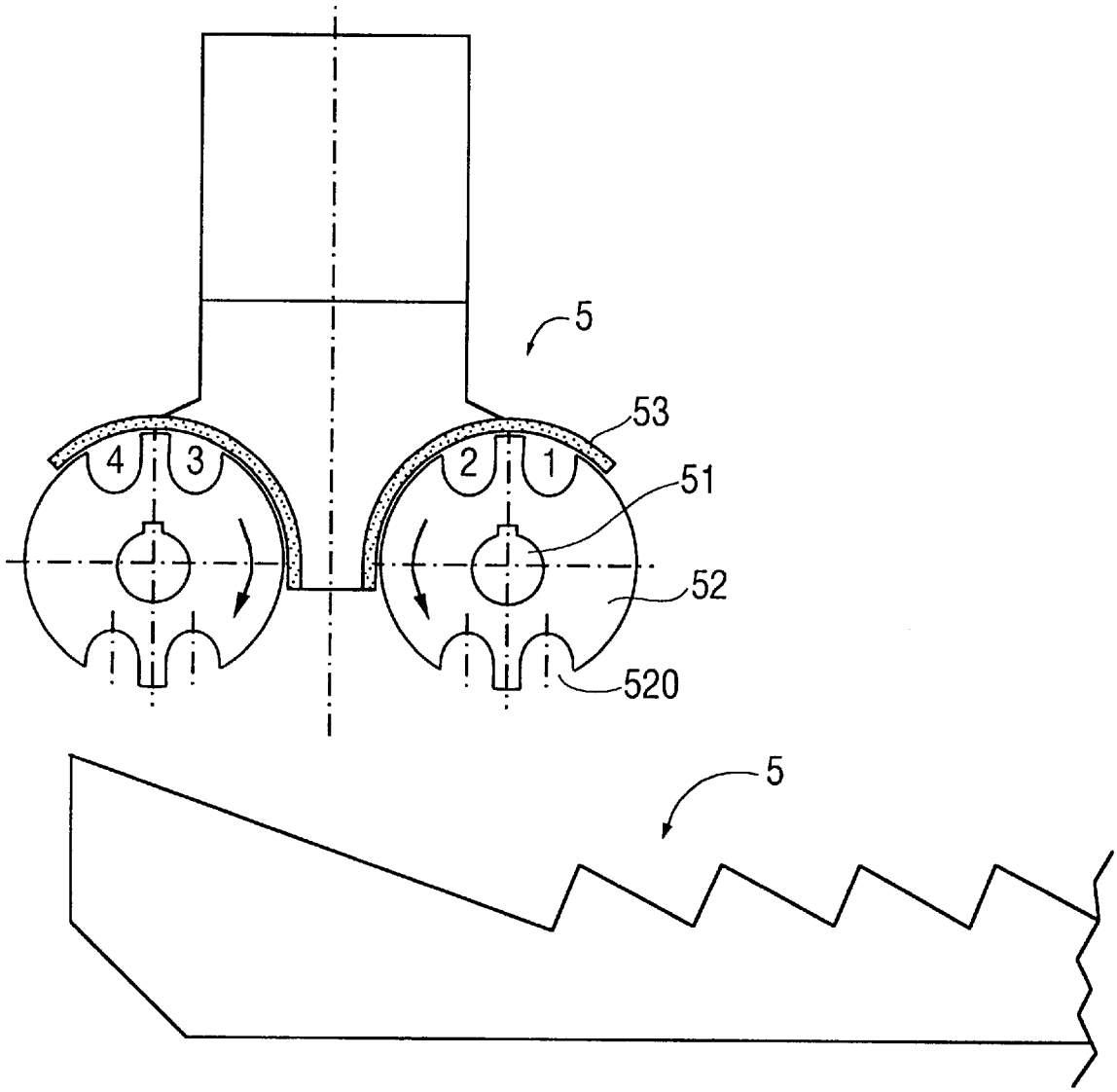
FIG. 1 is a simplified cross sectional view, on a vertical-plane of a device with a double drum device according to the present invention, where 1, 2, 3, 4 indicate the positions of progressive forwarding of four bars in logical succession into the respective channels in the two drums.
Figure 2A:
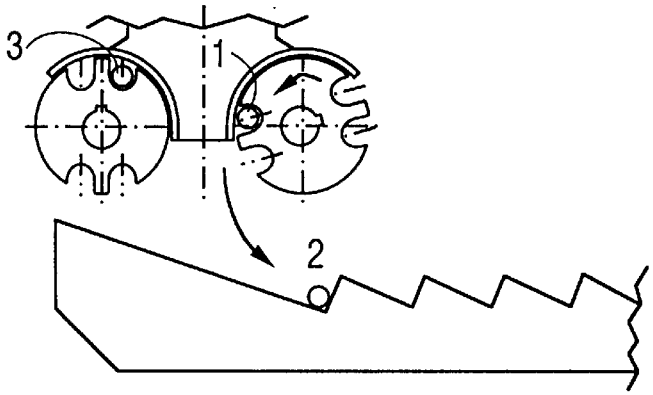
FIGS. 2A–2D indicate the phases of logical succession showing how the bars are received and discharged according to the present invention.
Figure 2B:
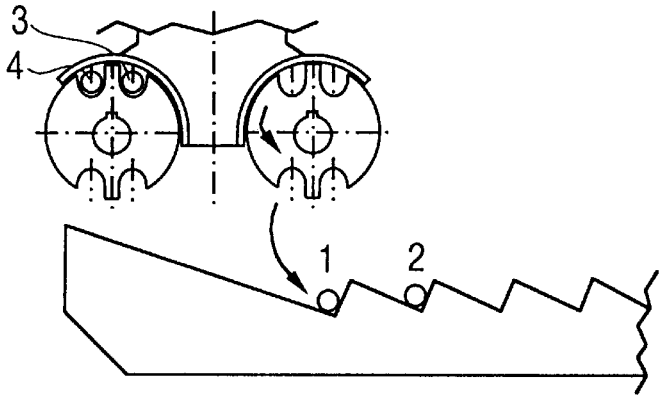
Figure 2C:
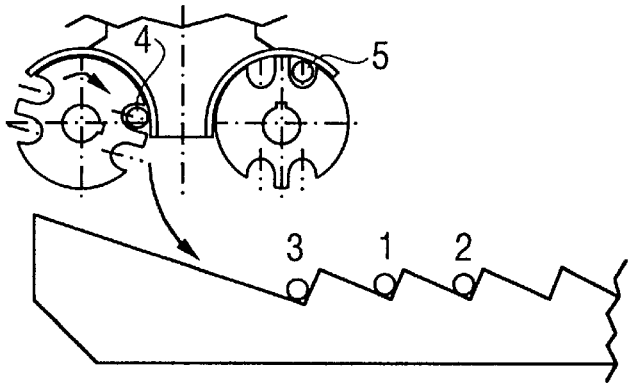
Figure 2D:
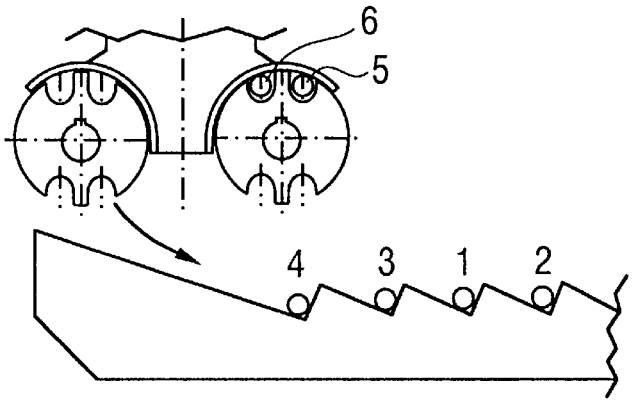

In order to avoid discharging two bars for each tooth of the cooling bed, the drum stops for a suitable time, in an intermediate angular position, for example at 100° (as shown in FIG. 2A). Thus it is possible to discharge the bar corresponding to 2 and retain the bar corresponding to 1 in order to allow the discharging and cooling bed to advance the bar corresponding to 2, and thereby position the next opening for receiving the bar corresponding to 1.

This solution also allows two bars to be received simultaneously as they exit from a "SPLIT" rolling mil or from a double wired rolling mill as in IT-A-83489A/88.

It must additionally be noted that at the entry of the receiving and discharging device according to the present invention four bar-brakers are obviously necessary, as for the IT-A-83489A/88 system. The device can also receive only one bar per drum (in the case of large rod sections with lower speed), in which case only one channel per drum and only two-brakers will be used.

The above method is applicable also in the case where the drums rotate oppositely to the directions previously disclosed. The subsequent phases for four bars according to the present invention, are clearly explained by FIG. 2. Obviously in the solution, four channels for each drum are preferentially shown but they could be also of greater number. Advantageously, as per the figures the respective channels 520 are disposed in opposed pairs for each drum.

What is claimed is:

1. A method for depositing bars onto a cooling bed in a rolling mill plant, comprising:

receiving a first bar in a first channel of a first drum;

receiving a second bar in a second channel of said first drum;

receiving a third bar in a first channel of a second drum;

receiving a fourth bar in a second channel of said second drum;

rotating said first drum through a first angle, thereby discharging said first bar from said first channel of said first drum onto the cooling bed; then rotating said first drum through a second angle, thereby discharging said second bar from said second channel of said first drum onto the cooling bed; then rotating said second drum through a first angle, thereby discharging said third bar from said first channel of said second drum onto the cooling bed; and then rotating said second drum through a second angle, thereby discharging said fourth bar from said second channel of said second drum onto the cooling bed.

2. The method according to claim 1, wherein the receiving of said third and fourth bars in said first and second channels of said second drum, respectively, occurs while rotating said first drum.

3. The method according to claim 1, wherein the receiving of said second bar in said second channel of said first drum occurs before the receiving of said first bar in said first channel of said first drum, the receiving of said third bar in said first channel of said second drum occurs before the receiving of said fourth bar in said second channel of said second drum, and the receiving of said first and second bars in said first and second channels of said first drum occurs before the receiving of said third and fourth bars in said first and second channels of said second drum.

4. The method according to claim 1, and further comprising intermittently stopping rotation of said first drum after rotation of said first drum through its first angle, and intermittently stopping rotation of said second drum after rotation of said second drum through its first angle.

5. The method according to claim 1, and further comprising:

receiving a fifth bar in a third channel of said first drum;

receiving a sixth bar in a fourth channel of said first drum;

receiving a seventh bar in a third channel of said second drum;

receiving an eighth bar in a fourth channel of said second drum;

rotating said first drum through a third angle, thereby discharging said fifth bar from said third channel of said first drum onto the cooling bed; then rotating said first drum through a fourth angle, thereby discharging said sixth bar from said fourth channel of said first drum onto the cooling bed; then rotating said second drum through a third angle, thereby discharging said seventh bar from said third channel of said second drum onto the cooling bed; and then rotating said second drum through a fourth angle, thereby discharging said eighth bar from said fourth channel of said second drum onto the cooling bed.

6. The method according to claim 2, wherein the receiving of said second bar in said second channel of said first drum occurs before the receiving of said first bar in said first channel of said first drum, the receiving of said third bar in said first channel of said second drum occurs before the receiving of said fourth bar in said second channel of said second drum, and the receiving of said first and second bars in said first and second channels of said first drum occurs before the receiving of said third and fourth bars in said first and second channels of said second drum.

7. The method according to claim 2, and further comprising intermittently stopping rotation of said first drum after rotation of said first drum through its first angle, and intermittently stopping rotation of said second drum after rotation of said second drum through its first angle.

8. The method according to claim 6, and further comprising intermittently stopping rotation of said first drum after rotation of said first drum through its first angle, and intermittently stopping rotation of said second drum after rotation of said second drum through its first angle.

9. The method according to claim 3, and further comprising intermittently stopping rotation of said first drum after rotation of said first drum through its first angle, and intermittently stopping rotation of said second drum after rotation of said second drum through its first angle.

10. The method according to claim 5, wherein the receiving of said fifth and sixth bars in said third and fourth channels of said first drum, respectively, occurs while rotating said second drum, and the receiving of said seventh and eighth bars in said third and fourth channels of said second drum, respectively, occurs while rotating said first drum.

11. The method according to claim 5, wherein the receiving of said sixth bar in said fourth channel of said first drum occurs before the receiving of said fifth bar in said third channel of said first drum, the receiving of said seventh bar in said third channel of said second drum occurs before the receiving of said eighth bar in said fourth channel of said second drum, and the receiving of said fifth and sixth bars in said third and fourth channels of said first drum occurs before the receiving of said seventh and eighth bars in said third and fourth channels of said second drum.

12. The method according to claim 5, and further comprising intermittently stopping rotation of said first drum after rotation of said first drum through its third angle, and intermittently stopping rotation of said second drum after rotation of said second drum through its third angle.

13. The method according to claim 10, wherein the receiving of said sixth bar in said fourth channel of said first drum occurs before the receiving of said fifth bar in said third channel of said first drum, the receiving of said seventh bar in said third channel of said second drum occurs before the receiving of said eighth bar in said fourth channel of said second drum, and the receiving of said fifth and sixth bars in said third and fourth channels of said first drum occurs before the receiving of said seventh and eighth bars in said third and fourth channels of said second drum.

14. The method according to claim 10, and further comprising intermittently stopping rotation of said first drum after rotation of said first drum through its third angle, and intermittently stopping rotation of said second drum after rotation of said second drum through its third angle.

15. The method according to claim 13, and further comprising intermittently stopping rotation of said first drum after rotation of said first drum through its third angle, and intermittently stopping rotation of said second drum after rotation of said second drum through its third angle.

16. The method according to claim 11, and further comprising intermittently stopping rotation of said first drum after rotation of said first drum through its third angle, and intermittently stopping rotation of said second drum after rotation of said second drum through its third angle.

* * * * *